US006546883B1

(12) United States Patent
Fink et al.

(10) Patent No.: US 6,546,883 B1
(45) Date of Patent: Apr. 15, 2003

(54) THERMO-OXIDIZER EVAPORATOR

(75) Inventors: Ronald George Fink, Jupiter, FL (US); Andrew Charles Hyatt, Stuart, FL (US); Walter Bernard Ellis, Jupiter, FL (US)

(73) Assignee: RGF, Inc., West Palm Beach, FL (US)

( * ) Notice: Subject to any disclaimer, the term of this patent is extended or adjusted under 35 U.S.C. 154(b) by 0 days.

(21) Appl. No.: 09/616,189

(22) Filed: Jul. 14, 2000

(51) Int. Cl.[7] ..... F23G 7/04; F23C 1/10; F23M 9/00

(52) U.S. Cl. ..... 110/238; 110/262; 110/322; 110/346

(58) Field of Search ..... 110/238, 260, 110/262, 322, 323, 342, 346, 348; 202/160

(56) References Cited

U.S. PATENT DOCUMENTS 1,782,822 A * 11/1930 Hechenbleinker ..... 202/160
2,848,958 A * 8/1958 Komar ..... 110/22
3,954,381 A * 5/1976 Marecaux ..... 431/2
4,013,023 A * 3/1977 Lombana et al. ..... 110/8 A
4,474,121 A * 10/1984 Lewis ..... 110/346
4,627,388 A * 12/1986 Buice ..... 122/149
4,708,775 A * 11/1987 McGregor et al. ..... 203/40
4,915,038 A * 4/1990 Sujata et al. ..... 110/346
4,957,050 A * 9/1990 Ho ..... 110/346
5,156,098 A * 10/1992 Camp ..... 110/238
RE34,298 E * 6/1993 Gitman et al. ..... 431/5
5,342,482 A * 8/1994 Duesel ..... 159/DIG. 2
5,634,413 A * 6/1997 Listner et al. ..... 110/238
5,762,486 A * 6/1998 Leger ..... 431/8
6,200,428 B1 * 3/2001 VanKouwenberg ..... 202/160
6,234,092 B1 * 5/2001 Domschke et al. ..... 110/238
6,279,493 B1 * 8/2001 Beaumont et al. ..... 110/346
6,309,542 B1 * 10/2001 Kim ..... 210/222

OTHER PUBLICATIONS

Specification for Thermo–oxidizer.

* cited by examiner

*Primary Examiner*—Ira S. Lazarus
*Assistant Examiner*—K. B. Rinehart
(74) *Attorney, Agent, or Firm*—Malin, Haley & DiMaggio, P.A.

(57) ABSTRACT

A thermo-oxidizer evaporator is provided with a combustion chamber, burners, and waste water injection system. The waste water injection system is preferably adapted to atomize the waste water stream. The waste water is injected near the flame from the burners so as to evaporate water in the waste water stream and combust contaminants in the waste water stream. The water leaves the combustion chamber as vapor, and contaminants collect at the bottom of the combustion chamber as dry ash. Heat exchange apparatus heats air prior to injection into the combustion chamber. A temperature controller controls fuel and air flow into the combustion chamber. Baffles in the combustion chamber increase the residence time to facilitate the settling of solid constituents from the gas stream leaving the combustion chamber. Methods for treating liquid wastes are also disclosed.

9 Claims, 6 Drawing Sheets

THERMO-OXIDIZER EVAPORATOR

FIELD OF THE INVENTION

This invention relates generally to waste treatment apparatus, and more particularly to thermo-oxidizer evaporators.

BACKGROUND OF THE INVENTION

Waste water streams pose particular challenges for efficient and effective disposal. Environmental concerns prevent most waste water streams from being dumped into rivers, lakes or oceans without extensive treatment to remove contaminants. Most industrial waste water streams cannot be sewered. The only alternative for disposal of many waste water streams is to haul the waste water to an appropriate treatment facility. The transportation expense combined with the expense of treating this volume of waste can be excessive.

Waste water evaporators were devised to remove much of the water volume from the waste water stream, to lower the hauling costs of transporting this volume and weight of water to a waste water treatment station. Waste water evaporators transfer heat to the waste stream in a variety of methods to evaporate water from the waste. In one such evaporator, a vat is filled with the waste and a heat source is applied at the bottom of the vat to transfer heat through the vat to evaporate water from the waste. Another method is to have a heating tube coiled inside the vat, and to direct a heating fluid through the tube such that heat is transferred through the tube to the waste stream. A third method is to provide electrodes within the vat to heat the waste stream.

Traditional evaporators pump more waste water into the vat when the waste level in the vat has dropped to a set point level. Over time, evaporation of the water from the vat with added waste water increases the concentration of non-evaporated constituents in the vat. As the concentration of solids in the water increases, the likelihood that more contaminants will be carried with the evaporated water also increases. The increasing solids concentration also decreases the efficiency of the evaporator because the applied heat is absorbed by the accumulating solids in the vat. Also, the solids line the vat surface and cover the heating elements, tubes and other components in the vat such as level sensors. The accumulating solids on the surfaces of the vat, as well as heating tubes and elements, create a resistance to heat transfer which increases the overall cost of operation, since more energy must be expended in order to transfer heat through the solids to the waste water in the vat, and since heat will be absorbed by the solids.

A further problem with current evaporators is that the solids must periodically be removed from the vat. Drains are typically provided in the vat to remove sludge from the vat, however, this sludge must be at least 60% water in order to permit the sludge to flow through the drain. Sludge that remains coated on the vat and other elements and components must be cleaned periodically, usually with water. The sludge and cleaning water must be hauled away, which increases the cost of operating the evaporator.

A solution to the problems with evaporators has been the introduction of thermo-oxidizer evaporators. In such systems, the waste water stream is not heated in a vat, but instead is injected into a combustion chamber. The waste water stream is directed at the flame, which rapidly evaporates water in the stream and combusts organic constituents in the stream. The water vapor is directed out of the combustion chamber, and solids comprising inorganic constituents and dry ash collect at the bottom of the combustion chamber. The expense of transporting a heavy waste water stream is avoided, and many contaminants are thermally destructed or eliminated by combustion. The dry ash which collects at the bottom of the combustion chamber must be periodically removed, but the dry constitution of this ash facilitates removal, compared to the wet sludge which typically remains in vat evaporators, Further, there are no heating elements or tubes within the combustion chamber, heat does not have to be transferred through the walls, and solids accumulate at the bottom in the thermo-oxidizer evaporator and do not cause the same heat transfer efficiency problems as with typical vat evaporators.

SUMMARY OF THE INVENTION

A thermo-oxidizer evaporator is provided with a combustion chamber, burners, and waste water injection system. The waste water injection system is preferably adapted to atomize the waste water stream. The burners direct a flame near the waste water stream as it enters the combustion chamber so as to evaporate water in the waste water stream and combust contaminants in the waste water stream. The water leaves the combustion chamber as vapor, and contaminants collect at the bottom of the combustion chamber as dry ash. Heat exchange apparatus heats air prior to injection into the combustion chamber. A temperature controller controls fuel and air flow into the combustion chamber. Baffles in the combustion chamber increase the residence time to facilitate the settling of solid constituents from the gas stream leaving the combustion chamber.

A method for treating liquid waste according to the invention can include the steps of injecting the liquid waste into a combustion chamber; contacting the liquid waste with heat from the flame adapted to evaporate water in the liquid waste and to combust combustible materials in the liquid waste, where the flame is preferably generated by burners receiving air and fuel from supply lines. The air is preferably preheated by performing heat exchange with hot gases in the combustion chamber. The supply of air and fuel to the burners can be controlled by a controller responsive to at least the temperature in the combustion chamber. The liquid waste can be contacted in the combustion chamber with structure adapted to increase the residence time of the waste in the thermo-oxidizer evaporator to facilitate settling of particulates and combustion of combustible materials.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
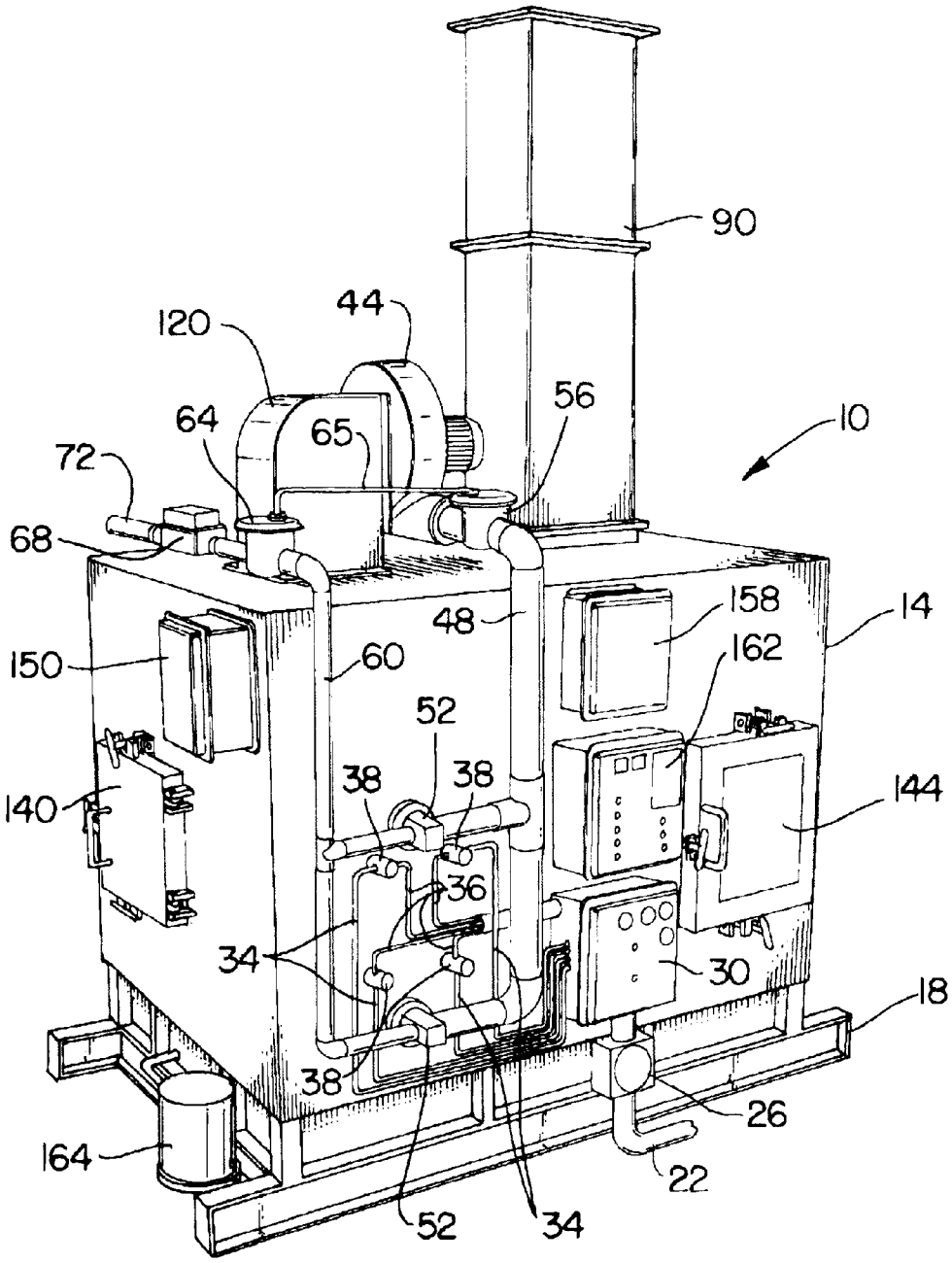
FIG. 1 is a perspective view of a thermo-oxidizer evaporator according to the invention.
Figure 2:
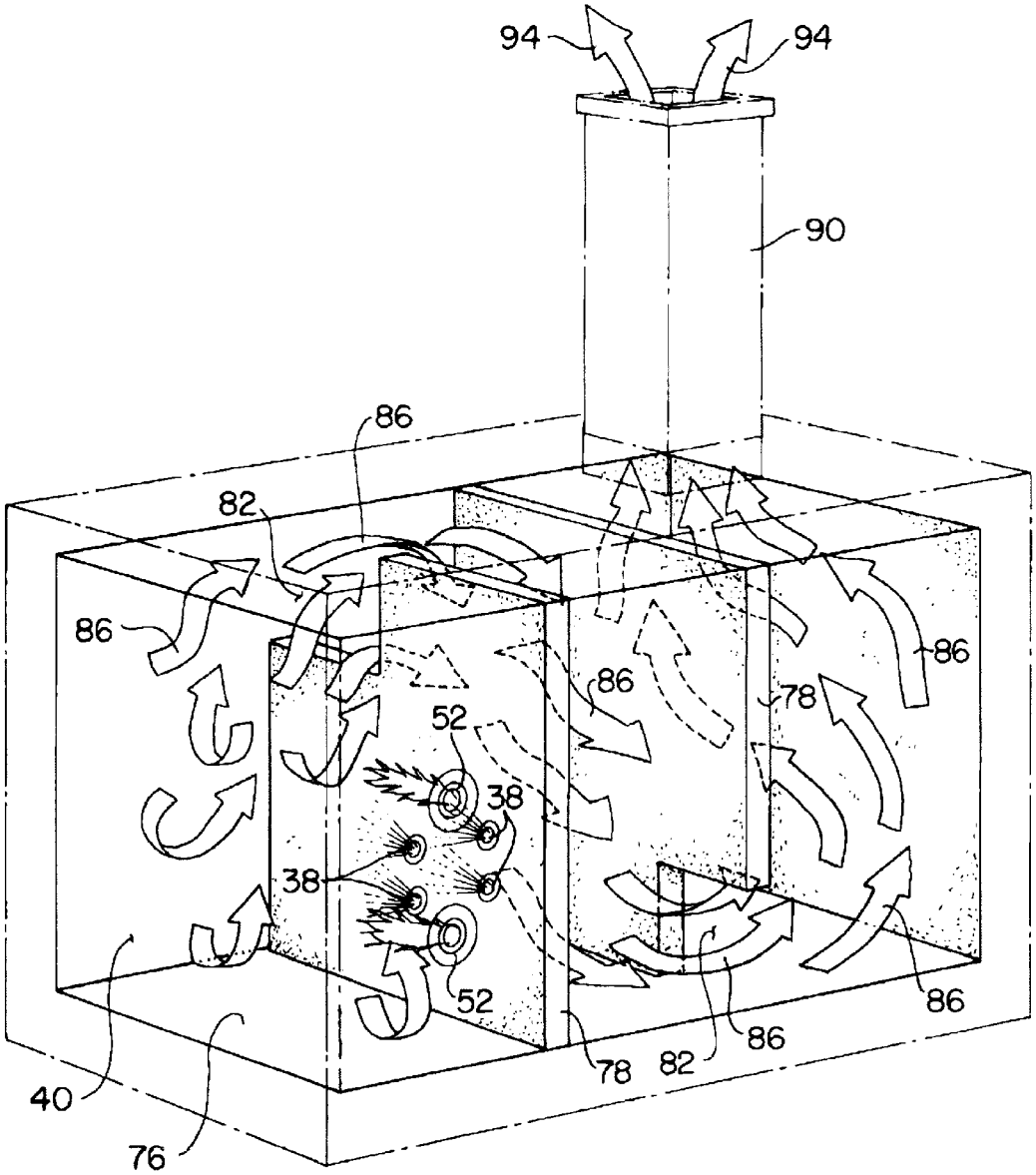
FIG. 2 is a schematic diagram, partially in phantom, illustrating the flow of air through the thermo-oxidizer evaporator.
Figure 3:
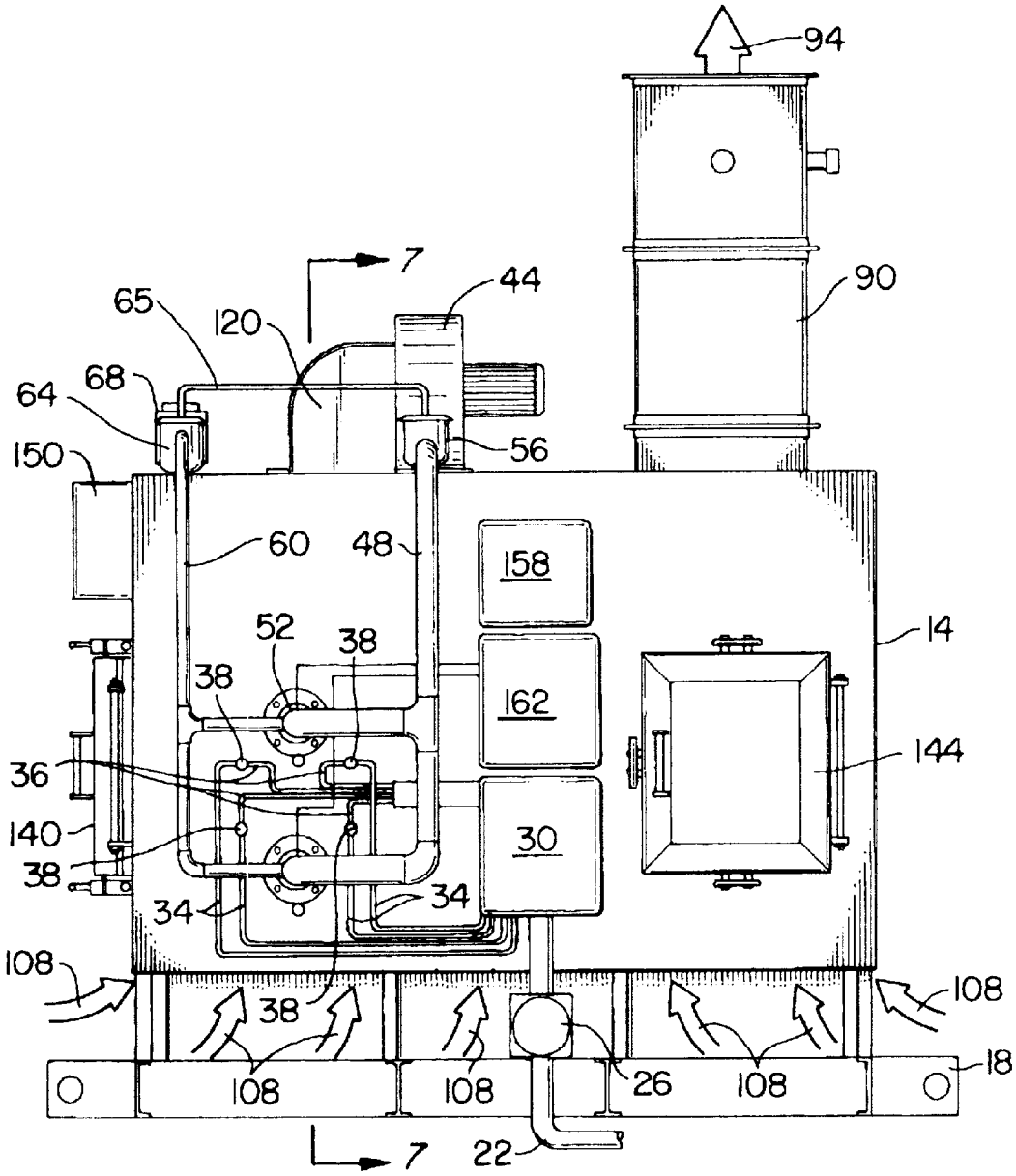
FIG. 3 is a front elevation of a thermo-oxidizer evaporator according to the invention.

A thermo-oxidizer evaporator 10 according to the invention includes a housing 14. The housing 14 can rest on a suitable supporting framework 18. Liquid waste arrives at the unit by means of a suitable supply source such as piping 22. A pump 26 can be utilized to meter the waste water stream to a liquid waste atomizer pump control 30. A series of supply lines 34 direct the waste water streams to one or more liquid waste atomizer nozzles 38. Compressed air from a source is delivered by supply lines 36 to the nozzles 38. The nozzles 38 atomize the liquid waste and direct the atomized waste water stream into a combustion chamber 40 (FIG. 2).

Air is provided by suitable structure such as a combustion blower 44, which can be of any suitable design. The combustion blower 44 directs the air through an air feed line 48 to one or more burners 52. A proportional control valve 56 can be provided in the air feed line 48 to control the flow rate of air reaching the burners 52. The burners 52 receive fuel from a fuel supply line 60. The fuel supply line 60 can have a proportional control valve 64 controlled by air feed line pressure and a fuel feed control system 68 to ensure the flow of fuel from the fuel supply line 72 to the burner 52. The fuel feed control system 68 regulates fuel pressure, preferably with high, low and closed settings. The proportional control valves 56 and 64 are connected by a proportional control line 65. Fuel flow through the proportional control valve 64 is regulated through proportional control line 65 according to the air flow through proportional control valve 56.

Appropriate control of the fuel/air mixture is necessary to control the temperature within the combustion chamber 40. This is accomplished by the proportional control valves 56 and 64 which meter an appropriate amount of air and fuel to the burners 52 to efficiently evaporate and combust the waste water stream as dictated by the temperature within the combustion chamber 40.

Figure 4:
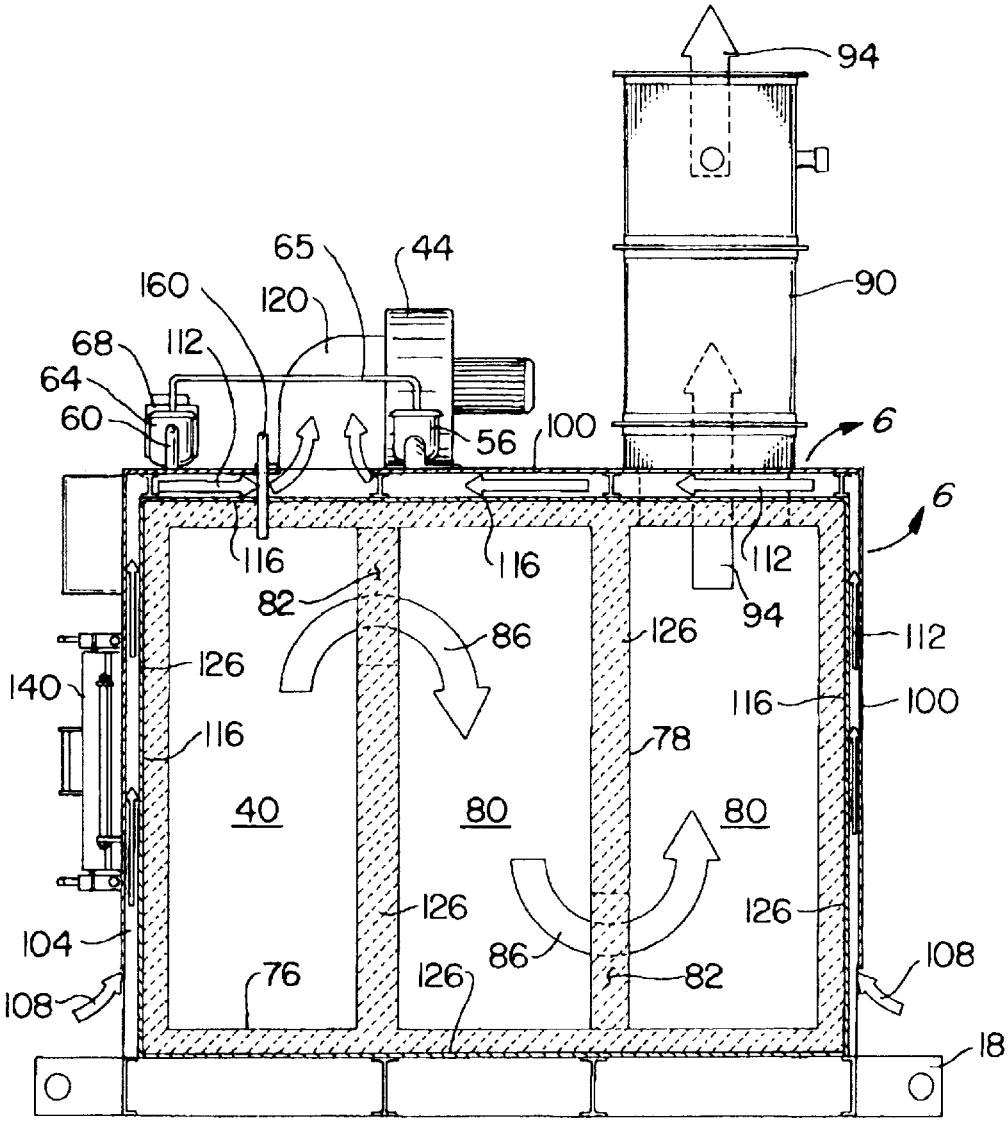
FIG. 4 is a front elevation, partially broken away to illustrate air flow through the thermo-oxidizer evaporator.
Figure 6:
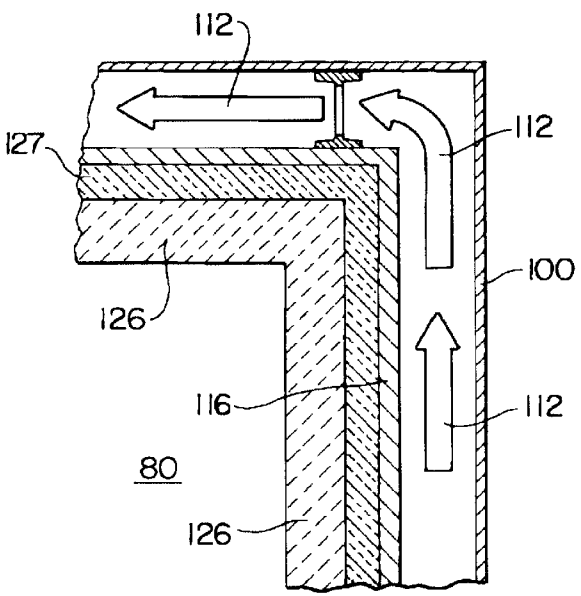
FIG. 6 is an enlarged view of the area indicated by arrows 6—6 in FIG. 4.
Figure 5:
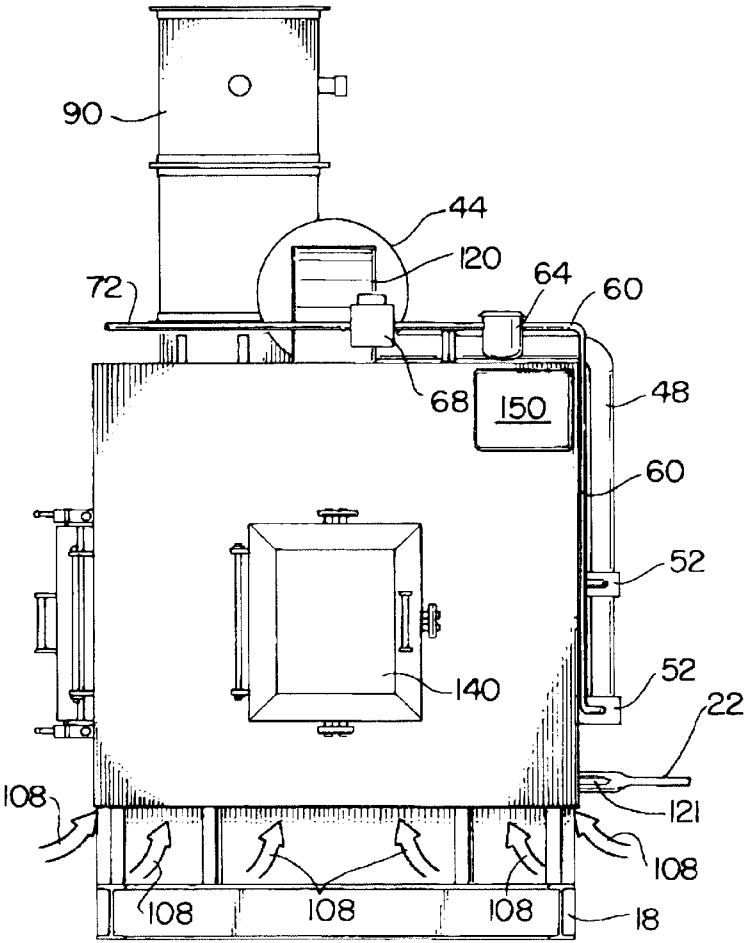
FIG. 5 is a side elevation of a thermo-oxidizer evaporator.
Figure 8:
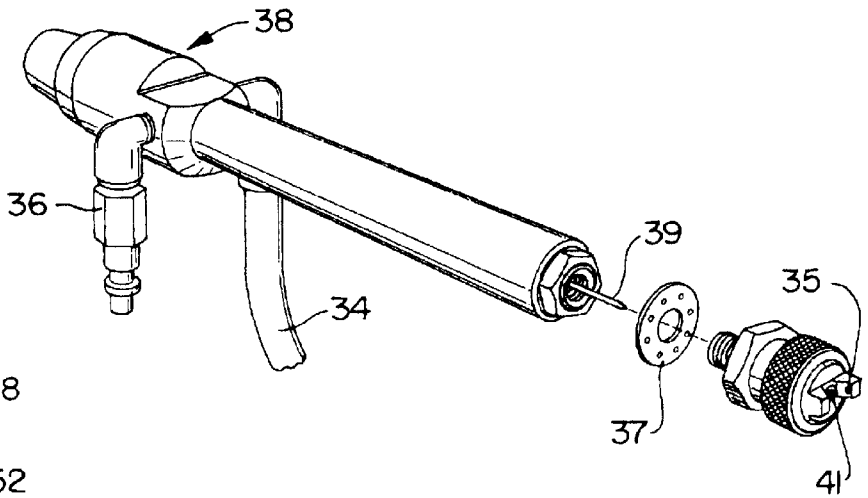
FIG. 8 is an exploded perspective view of an atomization nozzle according to the invention.
Figure 7:
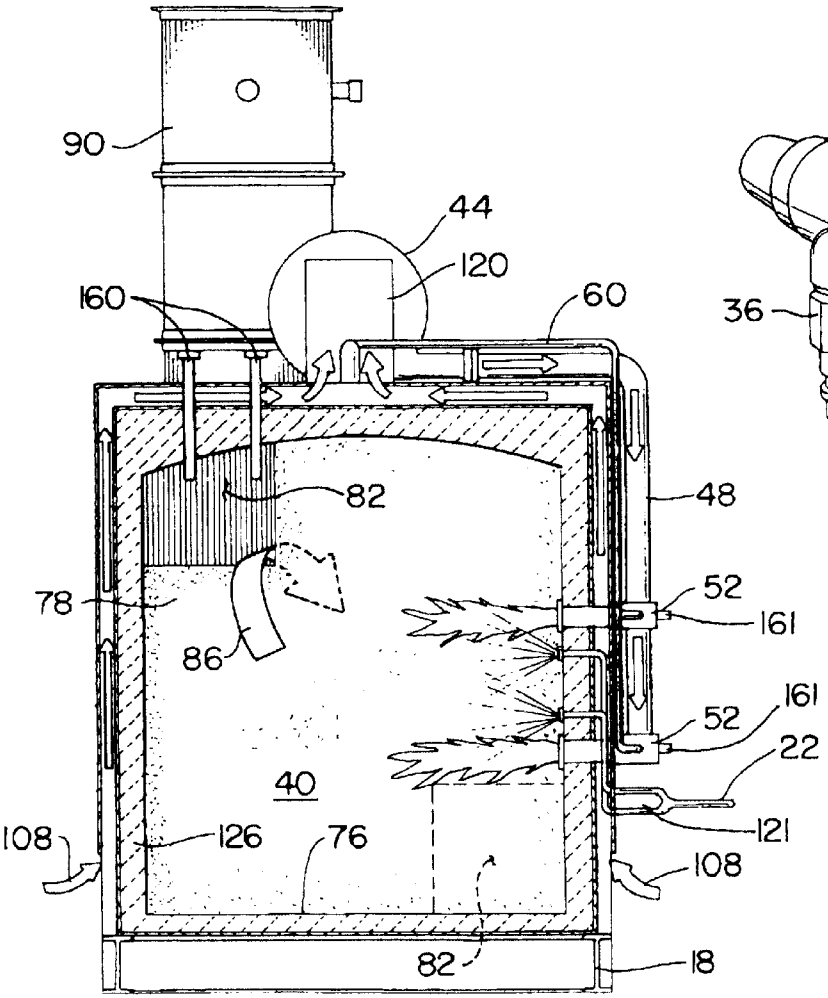
FIG. 7 is a cross-section taken along line 7—7 in FIG. 3.

Within the combustion chamber 40, liquid waste is atomized and heated rapidly by the burners 52 and is vaporized. Organic material in the waste water is combusted and collected at the floor 76 of the combustion chamber 40. In some cases BTU value is added by the combustion materials found in the flow rate of waste water. It is preferred to adjust the flow rate of waste water and/or the residence time of the air stream in the combustion chamber so as to ensure adequate combustion and settling of the combusted materials and inorganic materials from the gases prior to leaving the apparatus. Otherwise, further pre-filtration of waste stream or particulate separation steps must be performed on the exhaust gas. It is therefore preferable to provide one or more baffles 78 to define settling chambers 80 with flow openings 82 to create an irregular flow path for the air as indicated by arrows 86 in FIG. 2, FIG. 4, and FIG. 7. This will encourage the settling of particulate material prior to the exhaust of the gas through vent 90, as indicated by arrows 94. It may be necessary to remove some particulates from gas exiting through vent 90 by appropriate methods.

It is desirable that the ambient air that is used to fire the burners 52, and possibly also the air used to atomize the waste water stream, be preheated to improve the efficiency of the apparatus. The gases leaving the combustion chamber 40 and settling chambers 80 can have a temperature of 800 F. or more. It is therefore desirable to capture some of this heat by the provision of suitable heat exchange apparatus to transfer heat from the escaping gas to the inlet air. This is preferably performed by a jacket 100 which envelopes wall 116 of the combustion chamber 40 and settling chambers 80. The jacket 100 defines a passage 104 which receives ambient air as indicated by the arrows 108 in FIGS. 3–5 and 7. Air travels within the jacket 100 as indicated by arrows 112, such that it is preheated by contact with exterior walls 116 of the combustion chamber 40 and settling chambers 80. The hot walls 116 will transfer heat to the air, which will provide for more efficient combustion. The air preheating preferably increases the temperature of the air to 150° F. or more. The hot air is directed from the jacket 100 to a plenum 120 which directs the air to the combustion blower 44. Waste water piping 22 can further provide feed lines 121 (FIG. 7) which can run in the passage 104 to the nozzles 38, such that the waste water will also be pre-heated. Care must be taken, however, to avoid boiling the waste water.

The floor 76, interior wall 116 and baffles 78 are preferably constructed of a material which will resist degradation in the hot, moist and sometimes caustic environment within the combustion chamber 40 and settling chambers 80. Corrosive materials such as acids and chlorides are sometimes present in the waste water stream. A suitable high temperature lining material such as ceramic material 126 is therefore preferably used to coat and protect the wall 116 and floor 76. The material can also be used to form or coat the baffles 78. The ceramic liner is preferably a refractory material, and is preferably about 5" thick. A layer of insulation material 127, preferably about 2" thick, is also preferably provided to limit the amount of heat leaving the combustion chamber 40.

Access to the combustion chamber 40 is preferably provided by a suitable access door 140. This permits servicing and removal of the particulates from the combustion chamber 40. The access door 140 can be lined with the ceramic material to prevent degradative effects of the combustion environment. At least one other door 144 can be provided for accessing the settling chambers 80.

The nozzles 38 are specially designed for automatic cleaning. Preferably, the nozzles 38 have a plunger/cleaning mechanism 39. Preferred nozzles are made of 316 stainless steel and designed to pass up to 200 micron particles, utilizing an external mix. The angle of liquid waste ports 35 preferably creates two liquid streams which intersect at about a 60° arc. The air port 41 directs air preferably at the point of intersection of the two liquid streams. This results in atomization of the liquid streams, which will optimize evaporation. The length of the nozzle is preferably selected to avoid contact with the ceramic liner and to permit servicing of the nozzles. A copper seal 37 is used because of the higher temperature resistance than Teflon. The nozzle receives oxygen, preferably as air, from the line 36 and liquid waste from a line 34. The nozzle 39 preferably directs the atomized liquid waste near, but not directly into, the flame created by the burners 52. No flame impingement provides a clear flow path for the atomized liquid waste.

Control apparatus is preferably provided. Currently preferred control apparatus includes ignition and blower control 150 which provides a spark signal to ignite the burners 52. A burner modulation control 158 is also provided to determine if conditions are appropriate to ignite the burners 52. If so, a signal is sent to the ignition and blower control 150. A burner control 162 provides temperature and process controls. The burner control 162 sends signals to the air proportional control valve 56 according to the temperature within the combustion chamber 40, as sensed by thermocouples 160. A suitable sensor such as flame detector rods 161 can be used to send a signal to shut down the unit if the flame of the burners 52 goes out, to avoid a dangerous build-up of fuel in the combustion chamber. The flame detector rods 161 are preferably thermocouples incorporated in the burners 52. The liquid waste atomizer pump control 30 meters the flow of waste water and compressed air into the nozzles 38.

The temperature of the combustion chamber can be varied according to the constitution and volumetric flow rate of the waste water stream. It is currently preferred that the minimum temperature in the combustion chamber be about 800° F. For highly contaminated waste streams which, for example, may include volatile organic compounds (VOCs), the temperature within the combustion chamber can be increased to 1400° F.–1600° F. in order to provide for more thorough combustion of these constituents. Two or more thermocouples 160 can be provided to sense the temperature within the combustion chamber, and to provide feedback to the control systems, including the gas feed control system 68 and proportional air control valve 56 and fuel control valve 64, to alter the heat output of the burner 52. Waste streams that have higher solids content will require more fuel to overcome the energy that is used to heat the solids. The precise ratio and flow rate of air/water will depend in part on the constitution and flow rate of the waste water stream. A higher flow rate for the waste water stream will need more fuel/air to evaporate the greater volumetric flow rate of water. A higher solids content in the waste water will require more fuel because the solids absorb heat which otherwise would be available to evaporate water.

The residence time of the waste stream and gases in the combustion chamber 40 and settling chambers 80 will be a function of the waste stream flow rate, gas flow rate, and fuel flow rate, as well as the constitution of the waste stream. Currently preferred residence times are between about 1 and 3 seconds, with the most preferred residence time being at least about 2 seconds.

Fuels suitable for use in the invention include natural gas or liquid propane gas, although other fuels are possible. It is further possible to use No. 2 fuel oil or even waste oil as an alternative fuel. Waste oil provides particular advantages because it reduces the need for primary fuel and also saves the cost of disposal of the waste oil. Waste oil can be used to replace up to 500,000 BTUs per hour of natural gas or liquid propane gas, saving the fuel cost and eliminating this waste oil from the waste stream. The BTU content of waste oils, solvents and other combustible materials in the waste water can be utilized to reduce the amount of primary fuel that is required.

The chamber volume can be any suitable volume, but in a preferred embodiment is about 143 cubic ft. This size unit can dispose of up to 150 gallons per hour of waste water. Electrical requirements are 460 vac, 30 amps. The construction is $3/16^{th}$ inch steel plate. The process feed pump is a Teflon air diaphragm pump 0–3 GPM. The combustion blower motor is a 5 horsepower blower motor, 50 CFM 15 A. The air supply requirements are 60 CFM at 150 psi. The residence time is greater than 2 seconds. The primary burners are two 1.25 MMBTUH side-fired S.S. high efficiency burners. A flame monitor is provided as flame rods 161 which detect whether the flame is burning and, if not, shuts the system down. The fuel pressure is 1.5–2.5 lbs. L.P.G.: 11–13 inches W.C. A suitable stack is needed for all thermo-oxidizer models to achieve a natural exhaust with no mechanical devices. Approximately 12 ft. of stack is required for this embodiment. The thermocouples 160 are preferably type "K" thermocouples, made of inconnel steel.

Dry ash will build up at the bottom of the combustion chamber 40 and settling chambers 80. This dry ash must periodically be removed. Access to these chambers is provided by the doors 140 and 144. A door in the back of the unit is also provided. It is possible, due to the dry nature of the ash, to sweep, scrape, and vacuum the dry ash to effect efficient removal. A drain can be provided in the combustion chamber 40 to remove any liquid build-up, if improper combustion or evaporation occurs. The liquid can be collected in a reservoir 164, which can have a level sensor to shut down operation if the liquid level in the reservoir 164 becomes too high.

The invention has a number of advantages over conventional evaporators. No sewer connection is required. The evaporation rate is not dependent on air humidity or the temperature of the liquid. The waste water is evaporated, leaving only a dry ash containing only non-combustible contaminants. The cost of disposal or sewage is greatly reduced. There are no filters or membranes to clean.

The invention has a number of applications. These applications include waste disposal for petroleum, hydrocarbon waste, die casting, alkaline cleaners, machinery coolants, compressor wastes, ink and paint waste, reverse osmosis, nano-filtration, ultra-filtration, concentrators, tumbling solutions, waste haulers, process waste water, printed circuit board waste, tanker cleaning, floor scrubber water, plating solutions, textiles, heavy equipment, food processing, manufacturing processes, and general wash water.

This invention can take other forms without departing from the spirit or essential attributes thereof. Accordingly, reference should be had to the following claims, rather than to the foregoing specification, as indicating the scope of the invention.

We claim:

1. A thermo-oxidizer evaporator, comprising:

a combustion chamber;

a liquid waste supply line, and injection structure for injecting and atomizing liquid waste received from said supply line into said combustion chamber;

at least one burner adapted to evaporate said injected liquid waste, and air and fuel supply lines for said burner, heat from said flame substantially evaporating water in said liquid waste and combusting combustible material in said liquid waste; and, heat exchange structure of heating air from said air supply line with heat from said combustion chamber, whereby heated air is indirectly vented from the apparatus.

2. The thermo-oxidizer evaporator of claim 1, wherein said heat exchange structure comprises a flow channel for said air adjacent an outer wall of said combustion chamber, whereby said air will be heated by contact with said outer wall.

3. The thermo-oxidizer evaporator of claim 1, further comprising structure for increasing the residence time of said injected liquid waste in said thermo-oxidized evaporator, whereby solid materials in said liquid waste will settle and said combustible materials will be more completely combusted.

4. The thermo-oxidizer evaporator of claim 3, wherein said structure for increasing the residence time comprises at least one baffle.

5. The thermo-oxidizer evaporator of claim 1, wherein said air and fuel supply lines have control valves for regulating the flow of air and fuel to said burners, said valves being controlled by a controller responsive at least to a sensed temperature in said combustion chamber.

6. The thermo-oxidizer evaporator of claim 5, wherein said temperature is sensed by at least two thermocouples in said combustion chamber.

7. A vatless thermo-oxidizer evaporator, comprising:

a single unitary combustion chamber;

a liquid waste supply line, and injection structure for injecting and atomizing liquid waste received from said supply line into said combustion chamber;

at least one burner adapted to evaporate water in said liquid waste and simultaneously to combust combustible material in said liquid waste within said combustion chamber;

air and fuel supply lines to said burner, said air and fuel supply lines hang control valves for regulating the flow of air and fuel to said burner with said combustion chamber, said valves being controlled by a controller responsive at least to a sensed temperate in said combustion chamber; wherein said temperature is sensed by at least two thermocouples in said combustion chamber and, an at least partially separated structure of increasing the residence time of said injected liquid waste in said thermo-oxidizer evaporator, whereby solid particulate materials in said liquid waste will settle and said combustible materials will be more completely combusted by said burner.

8. A vatless thermo-oxidizer evaporator, comprising:

a single unitary combustion chamber;

a liquid waste supply line, and injection structure for injecting and atomizing liquid waste received from said supply line into said combustion chamber;

at least one burner adapted to evaporate water in said liquid waste and simultaneously to combust combustible material in said liquid waste within said combustion chamber; and, an at least partially separated structure of increasing the residence time of said injected liquid waste in said thermo-oxidizer evaporator, whereby solid particulate materials in said liquid waste will settle and said combustible materials will be more completely combusted by said burner; and heat exchange structure for heating air from said air supply line with heat from said combustion chamber whereby heated air is indirectly vented from the apparatus.

9. The thermo-oxidizer evaporator of claim 8, wherein said heat exchange structure comprises a flow channel for said air adjacent an outer wall of said combustion chamber, whereby said air will be heated by contact with said outer wall.

* * * * *